United States Patent [19]

Halbmann

[11] Patent Number: 4,603,557

[45] Date of Patent: Aug. 5, 1986

[54] REFRIGERATED-GOODS DISPLAY CASE

[75] Inventor: Manfred Halbmann, Mainz-Kostheim, Fed. Rep. of Germany

[73] Assignee: Linde Aktiengesellschaft, Wiesbaden, Fed. Rep. of Germany

[21] Appl. No.: 686,235

[22] Filed: Dec. 26, 1984

[30] Foreign Application Priority Data

Dec. 29, 1983 [DE] Fed. Rep. of Germany ..... 3347361

[51] Int. Cl.[4] ..... A47F 3/04

[52] U.S. Cl. ..... 62/255; 62/256; 62/258

[58] Field of Search ..... 62/256, 258, 255

[56] References Cited

U.S. PATENT DOCUMENTS

| | | | |
|---|---|---|---|
| 2,911,799 | 11/1959 | Guyton et al. | 62/256 X |
| 2,936,597 | 5/1960 | Stevens et al. | 62/256 |
| 4,308,726 | 1/1982 | Perez et al. | 62/256 |
| 4,408,465 | 10/1983 | Ibrahim | 62/256 X |

FOREIGN PATENT DOCUMENTS

| | | | |
|---|---|---|---|
| 668754 | 12/1965 | Belgium | 62/255 |
| 0016402 | 3/1980 | European Pat. Off. . | |
| 2460516 | 7/1976 | Fed. Rep. of Germany | 62/256 |
| 3241622 | 5/1984 | Fed. Rep. of Germany | 62/256 |

*Primary Examiner*—Lloyd L. King

*Attorney, Agent, or Firm*—Karl F. Ross; Herbert Dubno

[57] ABSTRACT

A refrigerated-goods display case has its cold-air circulating blowers located between fin sections of the refrigerating unit cooling heat exchanger or evaporator against the rear wall of the goods display compartment.

12 Claims, 5 Drawing Figures

REFRIGERATED-GOODS DISPLAY CASE

FIELD OF THE INVENTION

My present invention relates to a refrigerated-goods display case and, more particularly, a display case for refrigerated goods such as meat, of the type which comprises a display area and a device for cooling a gas stream, generally an airstream, and a device for circulating the airstream tnrough this space.

BACKGROUND OF THE INVENTION

Refrigerated-goods display cases generally are utilized in supermarkets and even smaller commercial and retail establishments and generally comprise a base or support upon which the goods are displayed on a surface within a viewing area which can be delimited by transparent walls or windows. This area, accessible from the rear of the display case to the worker, permits the consumer to see the goods which he or she may wish to purchase.

Generally a cooling unit is provided, e.g. a refrigerator, and means is also provided to circulate air which is cooled by the first mentioned unit through the case and over the goods displayed thereon.

The cooling of the goods can be either continuous or at time-spaced intervals and the cooling airstream is generated by passing it over the evaporator of the refrigerating unit, i.e. the heat exchanger of the latter which is cooled by the refrigerant.

The means for circulating the airstream may be a radial blower or fan which either draws the air from or forces the air into the cooled space above the goods-display platform.

Customarily the device for cooling and the means for circulating the air are located below the presentation surface of platform of the body of the display case.

The display case must be internally cleaned from time to time to remove various contaminants which may collect therein. For example, when the display case is used in a meat market or the like, blood and juices which may run down from the meat tend to collect on or below the platform or in crevices between the platform and the other walls of the display case. For sanitary reasons as well as for aesthetic reasons it is essential to be able to remove these contaminants. The washing operation may be carried out by hand and may require the use of a cleaning liquid which may drip down onto the air-circulating means as well as the refrigerating means.

Consequently, with conventional display cases of this type, the air-circulating means and the refrigerating means are generally provided so that they can be readily removed to remove such contaminants therefrom, e.g. after the platform upon which the goods are displayed has been removed.

However, while connectors and the like which allow these units to be removed can be readily provided, problems are involved in their removal since frequently they include sharp edges and the like which render them difficult to handle by personnel unskilled in the handling of mechanical devices such as the retail store personnel who are generally involved in the cleaning of such display cases.

A system in which, after the goods-display platform can be swung up to afford access to the air-circulating and refrigerating means located therebelow for cleaning purposes is described in European patent application EP-A No. 16 402. Cleaning even with this system is a problem.

One problem with this earlier system is that because the platform is utilized to support some or all of the means for circulating and cooling the air, it must be made relatively massive and heavy in order to afford the desired degree of stability. Furthermore, access is limited to a considerable part of the refrigerating system including the evaporator which cannot be removed even with this system in a simple manner.

OBJECTS OF THE INVENTION

It is, therefore, the principal object of the present invention to provide a refrigerated-goods display case which is free from the drawbacks of the display cases referred to earlier in affording an improved ability to clean the apparatus.

Another object of the invention is to provide an improved display case of the refrigerator type in which the entire construction is greatly simplified in spite of the fact that the use is also simplified.

SUMMARY OF THE INVENTION

These objects and others which will become apparent hereinafter are attained, in accordance with the present invention, by providing a refrigerated-goods display casewhich, by contrast with earlier systems in which the refrigerating unit and the air-circulating unit are located below the goods-display platform of the goods-display compartment, provides these units behind the goods-display compartment, i.e. rearwardly thereof.

By "behind" or "rearwardly" of the goods-display compartment, I mean upon the rear wall of this compartment, i.e. the generally upright wall on the vendor's side of the display case.

With the present invention, therefore, the body of the case is completely free from structures which are built into it in a place in which contaminants can accumulate on these structures, i.e. upon the refrigerating unit and the air-circulating unit. The body of the case is freely accessible for cleaning purposes and, since the air-circulating and refrigerating structures, especially the evaporator with its sharp edges, are located above the platform for the most part, the accumulation of contaminants thereon by gravity is minimized or eliminated completely.

A further important aspect of the invention is that because the refrigerating unit and the air-circulating unit are no longer located below the goods-display platform, the goods-display platform can be lowered within the case, thereby increasing the goods-display volume above this platform.

In a preferred embodiment of the invention, the refrigerating unit comprises an evaporator or cooling heat exchanger which is of the finned type and is disposed along the rear wall of the goods-display compartment and is subdivided into sections so that a respective air circulator can be located between each pair of these sections.

By providing the air circulators between the sections of the evaporator or rather the fins of the evaporator, I can reduce any limitation in the width of the display case resulting from the incorporation of the cooling and circulating means between the rear wall of the display and the goods-display compartment. In this case, both of the units, namely, the air-circulating unit and the refrigerating unit are located in a single vertical plane.

Acccording to another feature of the invention, the cooling unit or element communicates with the outlet side of the air circulator and, advantageously, the cooling unit or heat exchanger can be open at the top and the bottom and can be closed at its sides. In this case, the bottom of the cooling unit can communicate with the discharge side of the air circulator and the upper portion of the heat exchanger can communicate with the space containing the goods to be displayed.

According to another advantageous feature of the invention, a compartment is provided below the goods-display platform through which the recirculated air is drawn to the intake of the circulator which can be an axial intake, radial outflow blower provided in each of the spaces between the finned sections of the heat exchanger or evaporator.

Each air circulator can thereby be located in a downwardly open flow passage which communicates with the lower portions of the heat exchanger sections adjoining same.

The front side of each air circulator can thereby be closed against the goods-display compartment while the intake communicates with the passage formed below the goods-display platform and delimited on its upper side by this platform.

With this arrangement, the airstream is forced by the blower first downwardly to rise through the respective heat exchanger sections before it returns to the goods-display compartment having been cooled in the finned sections.

Two of the sidewalls closing each section and extending vertically can be fins of the evaporator.

It has been found to be advantageous to provide a worktable above the circulating and cooling units alông the back wall of the goods-display compartment and, for best results, the air circulators can be fans or blowers of the type described.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
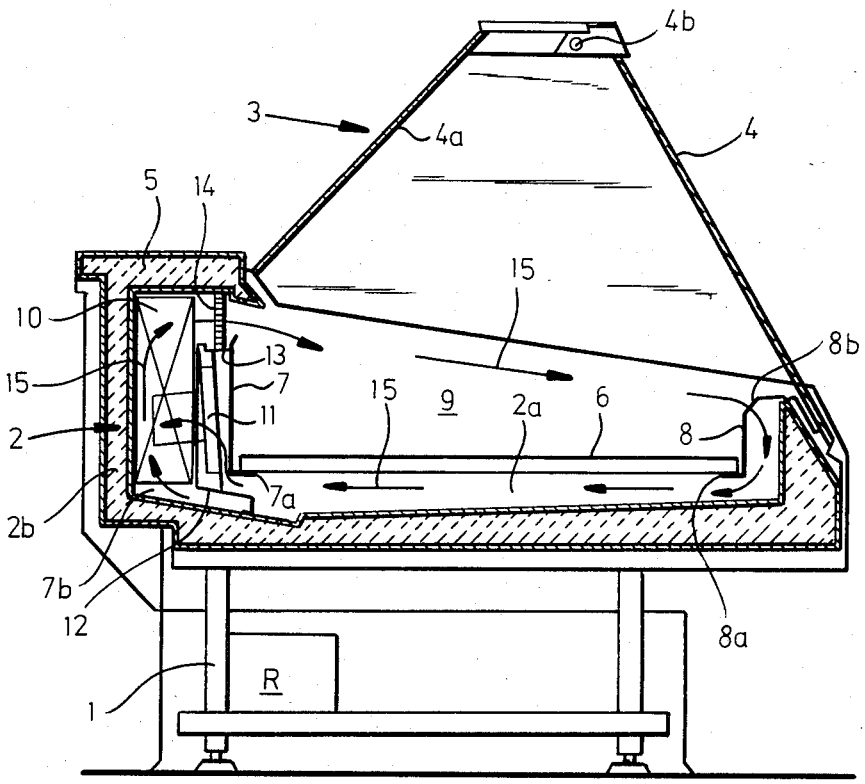
FIG. 1 is a vertical section through a refrigerated goods-display case according to the invention illustrated in highly diagrammatic form.

The goods-display case shown in FIGS. 1-3 comprises a base 1 which can be equipped with the refrigerating machine R to be connected to the evaporator disposed along the rear wall of the goods-display compartment in the manner to be described in greater detail hereinafter. The refrigerating machine R can have an electric motor-driven compressor, a condenser and a fan working with the condenser to dissipate heat abstracted from the goods-display compartment. The machine is equipped with the usual expansion valve and any other devices commonly utilized in refrigerated goods-display cases, e.g. thermostat controls and the like.

The base 1 carries the case body 2 and a viewing structure 3 which encloses a goods-display compartment located above a removable goods-display platform 6, the latter being supported on vertical plates 7 and 8 having inwardly turned flanges 7*a* and 8*a*. The structure 3 has a viewing window 4 which is fixed in place and through which, on the consumer side, the goods can be seen. A window 4*a* on the vendor's side is connected by hinges 4*b* to the structure so that it can be opened to allow the vendor to reach into the display case and remove the goods or position the goods on the platform 6.

Rearwardly of the window 4*a*, a worktable 5 is provided for the wrapping, cutting or assembling of the goods.

The worktable and body 2 of the display case is a double wall construction and filled with a thermal insulation.

The front plate is formed with a grill or other air intake 8*b* through which air is withdrawn from the goods-display compartment 9 and can be circulated as represented by the arrows 15. The circulating path includes a passage 2*a* below the platform 6 running to the rear of the display case which is represented on the left in FIG. 1. The display case can be used for meats, wursts, cheeses, salads, delicatessen and the like.

Along the rear wall 2*b* of the compartment 9, I provide an evaporator 10 whose refrigerant pipes communicate with the refrigerating unit R to complete the refrigerating cycle thereof.

Fans or blowers 11 (see especially FIGS. 3 and 5) are provided between finned sections of the evaporator, the front edge of the evaporator 10 being approximately coplanar with the front edge of the blowers 11, thereby ensuring that the blowers and the evaporator are practically coplanar as has been represented more diagrammatically in FIGS. 2-5.

A grillwork 14 can be provided above the blowers all across the blower and evaporator units the full length of the rear wall while individual plates 12 otherwise close the front faces of the evaporator sections.

The partition 12 can be a single wall provided with openings in which the blowers 11 are received if desired.

Figure 2:
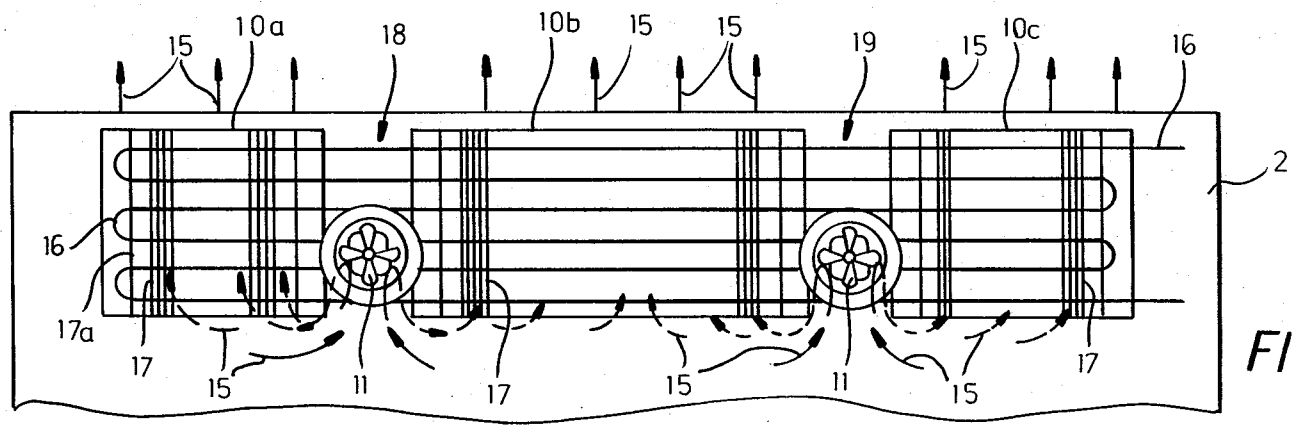
FIG. 2 is an elevational view of the rear wall of this goods-display case with the walls covering the fins of the finned sections of the evaporator removed.
Figure 3:
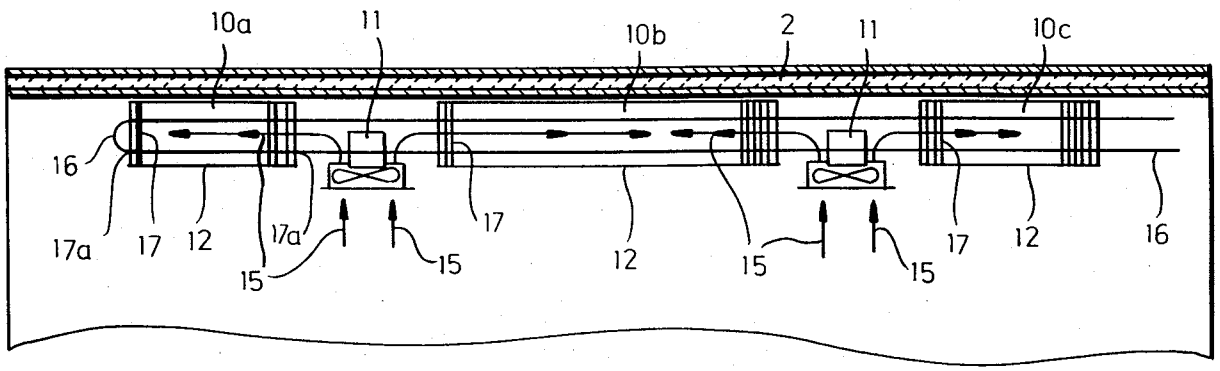
FIG. 3 is a horizontal section through the rear wall illustrating the construction from above and also, as FIG. 2, in highly diagrammatic form.

The air passages in which the blowers 11 are received are closed along their upper ends or sides by the covers 13 which define an air outflow path which is downwardly and communicates with the lower portions of the individual fin sections 10*a*, 10*b* and 10*c* as represented by the arrows in FIGS. 2 and 3.

The airstream through the sections 10*a*, 10*b* and 10*c* proceeds upwardly, the sections being closed off against the exterior by the fins 17*a* at each end of a section. The fins more generally are referred to at 17 and are mounted upon the refrigerant tubing represented at 16, the latter being connected as noted to the refrigerating machine R.

Figure 4:
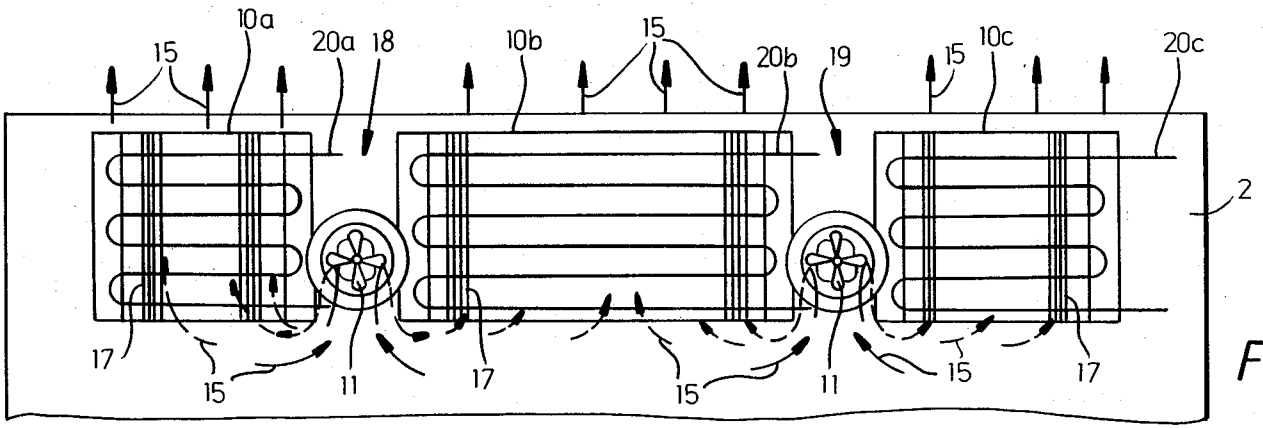
FIGS. 4 and 5 are views corresponding to FIGS. 2 and 3, respectively, but representing another embodiment of the invention.
Figure 5:
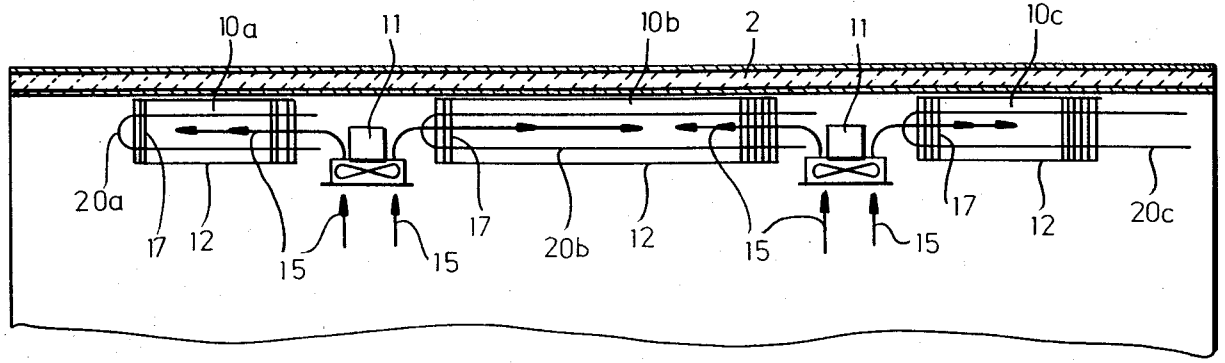

FIGS. 2 and 3 illustrate an embodiment which differs from that of FIGS. 4 and 5 in that in the embodiments of FIGS. 2 and 3, the evaporator comprises a single undulating tubing 16 for the refrigerant whereas in the embodiment of FIGS. 4 and 5, each of the finned sections 10*a*, 10*b* and 10*c* has a respective undulating tubing arrangement 20*a*, 20*b*, 20*c*, these tubings being connected in series or in parallel to the refrigerating machine. In the latter embodiment valves may be provided to selectively cut off or activate one or more sections. This arrangement permits accommodation to the refrigerating needs of the casing to a greater extent than does the embodiment of FIGS. 2 and 3 wherein all sections are always in use.

In both embodiments, therefore, the evaporator is subdivided into three sections 10*a*, 10*b*, 10*c* with the spaces 18 and 19 between these sections being sealed off upwardly and laterally. The covers 13 serve in this respect to seal off these spaces from the blower while the fins flanking the spaces seal them laterally from the heat exchanger sections.

This ensures, as shown, that the outflow from each blower 11 will pass into an intake passage 7*b* communicating with the underside of the respective evaporator section. The intake passage 7*b* is sealed off from the passage 2*a* so that the recirculated air passing below the platform enters the blower axially.

In both embodiments, of course, the region beneath the platform 6 is free from any elements which might make cleaning difficult or may impede proper scrubbing of the region. Since the circulating and cooling units 11, 10 are located above the platform 6, there is no danger that they will be contaminated by drippings from the goods-display compartment.

I claim:

1. A refrigerated-goods display case comprising:

a housing formed with a goods-display compartment having a platform upon which goods are displayed, a front side from which goods on said platform can be viewed, a rear side opposite said front side and a vertical rear wall at said rear side spaced rearwardly of said goods display compartment;

means including a blower in said housing at said rear side and rearwardly of said compartment but forwardly of said wall for circulating a cooling airstream over goods on said platform and along said wall; and means including a heat exchanger in said housing at said rear side along said wall and rearwardly of said compartment for cooling said airstream, said heat exchanger including a finned planar heat exchanger traversed by a refrigerant and disposed along said wall, the fins of said heat exchanger being separated along the length of said wall into spaced apart finned sections, said means for circulating being located in spaces between said finned sections.

2. The refrigerated-goods display case defined in claim 1 wherein said means for circulating has an intake and an output, said heat exchanger communicating with said output.

3. The refrigerated-goods display case defined in claim 1 wherein said heat exchanger includes inlet means at a lower portion for admitting said stream and outlet means at an upper portion for feeding the airstream after cooling to said compartment, said heat exchanger being closed against said compartment except for said lower and upper portions.

4. The refrigerated-goods display case defined in claim 1 wherein said blower is located in a downwardly open flow passage receiving said airstream from below said passage.

5. The refrigerated-goods display case defined in claim 4 wherein each passage is closed upwardly and laterally and opens downwardly to feed the airstream to said heat exchanger from below.

6. The refrigerated-goods display case defined in claim 1 wherein a workshelf for service personnel is provided above said means for cooling and said means for circulating.

7. The refrigerated-goods display case defined in claim 1 wherein a plurality of said spaces are provided, said means for circulating including a respective axial intake, radial outflow blower in each of said spaces substantially coplanar with said heat exchanger.

8. The refrigerated-goods display case defined in claim 7 wherein each of said blowers has an intake and an output, said heat exchanger communicating with said output.

9. The refrigerated-goods dispay case defined in claim 8 wherein said heat exchanger includes inlet means at a lower portion for admitting said stream and outlet means at an upper portion for feeding the airstream after cooling to said compartment, said heat exchanger being closed against said compartment except for said lower and upper portions.

10. The refrigerated-goods display case defined in claim 9 wherein said means for circulating is located in a downwardly open flow passage receiving said airstream from below said passage.

11. The refrigerated-goods display case defined in claim 12 wherein said passage is closed upwardly and laterally and opens downwardly to feed the airstream to said heat exchanger from below.

12. The refrigerated-goods display case defined in claim 11 wherein a workshelf for service personnel is provided above said means for cooling and said means for circulating.

* * * * *